US011326315B2

(12) United States Patent
Dougherty

(10) Patent No.: US 11,326,315 B2
(45) Date of Patent: May 10, 2022

(54) ROTATABLE PLOW SHOVEL APPARATUS

(71) Applicant: David Dougherty, Colorado Springs, CO (US)

(72) Inventor: David Dougherty, Colorado Springs, CO (US)

( * ) Notice: Subject to any disclaimer, the term of this patent is extended or adjusted under 35 U.S.C. 154(b) by 495 days.

(21) Appl. No.: 16/559,832

(22) Filed: Sep. 4, 2019

(65) Prior Publication Data

US 2021/0062445 A1 Mar. 4, 2021

(51) Int. Cl.
*E01H 5/02* (2006.01)
*E01H 5/06* (2006.01)

(52) U.S. Cl.
CPC ..... *E01H 5/02* (2013.01); *E01H 5/061* (2013.01); *E01H 5/065* (2013.01)

(58) Field of Classification Search
CPC ..... E01H 5/02; E01H 5/061; E01H 5/065
USPC ..... 37/264, 284, 285
See application file for complete search history.

(56) References Cited

U.S. PATENT DOCUMENTS 1,524,639 A * 1/1925 Grady ..... E01H 5/02 37/284
D381,875 S 8/1997 Spear
5,727,829 A * 3/1998 Bellichak ..... A01B 1/20 294/51
5,829,808 A 11/1998 Colla
5,984,393 A * 11/1999 Washington ..... B25G 1/06 294/54.5
6,053,548 A 4/2000 Bowles
6,125,720 A * 10/2000 Gohman ..... E04D 15/003 254/131.5
6,290,273 B1 9/2001 Moisan
6,675,507 B2 * 1/2004 Petruzzelli ..... E01H 5/02 37/284
6,948,268 B1 * 9/2005 Ronca ..... E01H 5/02 37/284
7,380,848 B2 6/2008 Petruzelli
8,177,272 B2 5/2012 Schinella, Jr.
8,457,757 B2 6/2013 Cauller
8,800,175 B1 8/2014 Faraci
9,255,368 B1 * 2/2016 Doolittle ..... E01H 5/02
2016/0113186 A1 * 4/2016 Mcafee ..... E04D 15/003 294/51

FOREIGN PATENT DOCUMENTS

EP 2 343 414 * 7/2011

* cited by examiner

*Primary Examiner* — Gary S Hartmann

(57) ABSTRACT

A rotatable plow shovel apparatus for clearing a path without having to lift includes a plow blade and a shaft housing having a curved front face coupled to a back side of the plow blade. A shaft aperture extends through a top side of the shaft housing to proximal a bottom side and the back face has a plurality of adjustment apertures extending through to the shaft aperture. A handle shaft has a vertical engagement portion rotatably engaged within the shaft aperture and an angled extension portion coupled to the engagement portion. A locking pin is coupled to the engagement portion and is selectively engageable with each of the plurality of adjustment apertures of the shaft housing to lock the handle shaft in a straight position, at least one alternative left tilt position, and at least one alternative right tilt position.

15 Claims, 5 Drawing Sheets

ROTATABLE PLOW SHOVEL APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to shovels and more particularly pertains to a new shovel for clearing a path without having to lift.

BRIEF SUMMARY OF THE INVENTION

An embodiment of the disclosure meets the needs presented above by generally comprising a plow blade having a concave front side, a back side, a left edge, and a right edge. A shaft housing has a curved front face coupled to the back side of the plow blade, a vertical back face, a top side, and a bottom side. A shaft aperture extends through the top side to proximal the bottom side. The back face has a plurality of adjustment apertures extending through to the shaft aperture with a central adjustment aperture extending through a midline of the shaft housing. A handle shaft is coupled to the shaft housing. The handle shaft has a vertical engagement portion and an angled extension portion coupled to the engagement portion. The engagement portion is rotatably engageable within the shaft aperture of the shaft housing. A locking pin is coupled to the engagement portion and is selectively engageable with each of the plurality of adjustment apertures of the shaft housing to lock the handle shaft in a straight position, at least one alternative left tilt position, and at least one alternative right tilt position. The handle shaft in the straight position lies in a plane perpendicular to a vertical tangent plane to the back side of the plow blade, the handle shaft in the left tilt position lies in a plane forming an acute angle with the vertical tangent plane relative the left edge, and the handle shaft in the right tilt position lies in a plane forming an acute angle with the vertical tangent plane relative the right edge. A first handle grip is coupled to a proximal end of the extension portion of the handle shaft.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
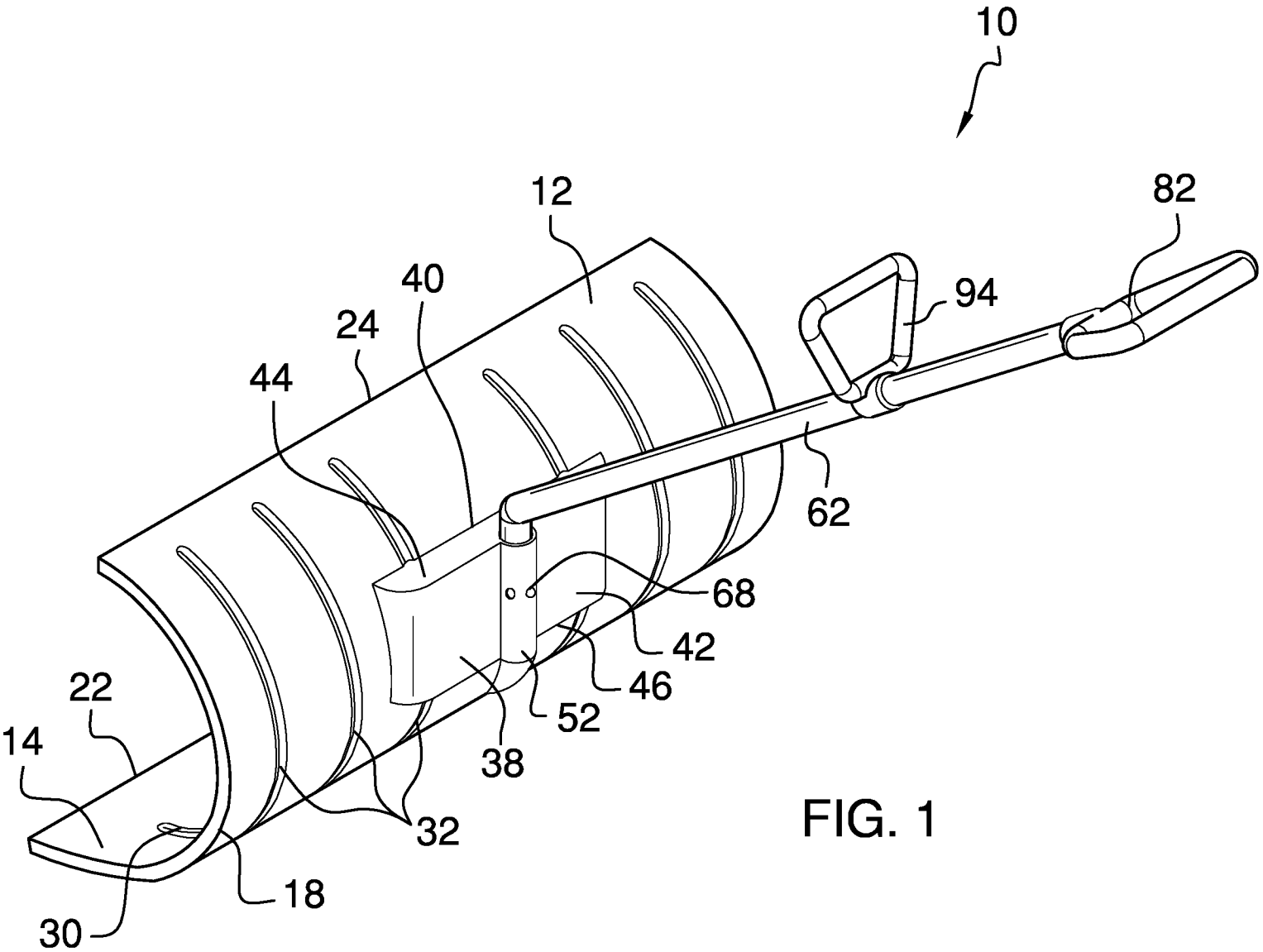
FIG. 1 is an isometric view of a rotatable plow shovel apparatus according to an embodiment of the disclosure.
Figure 2:
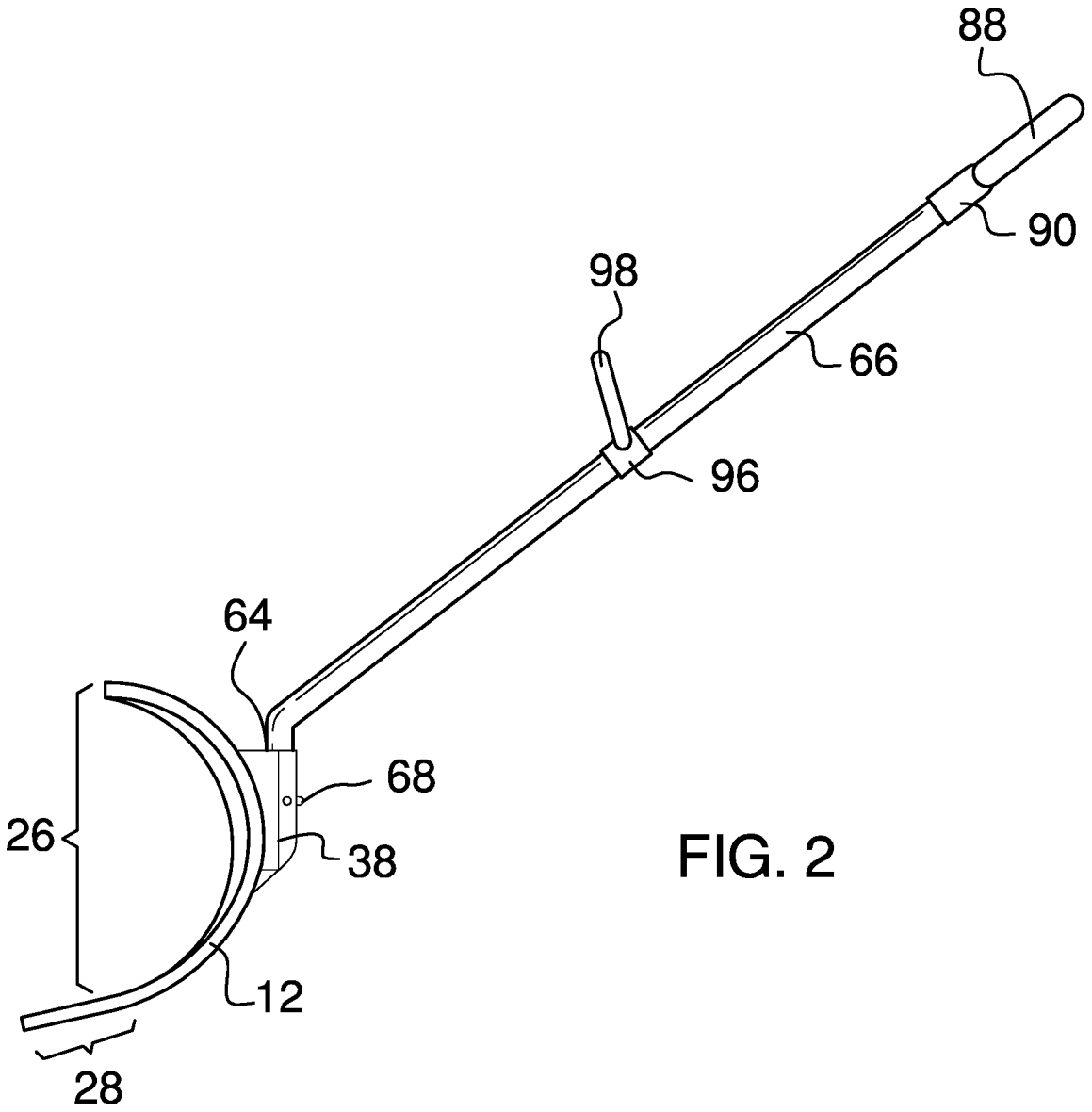
FIG. 2 is a side elevation view of an embodiment of the disclosure.
Figure 3:
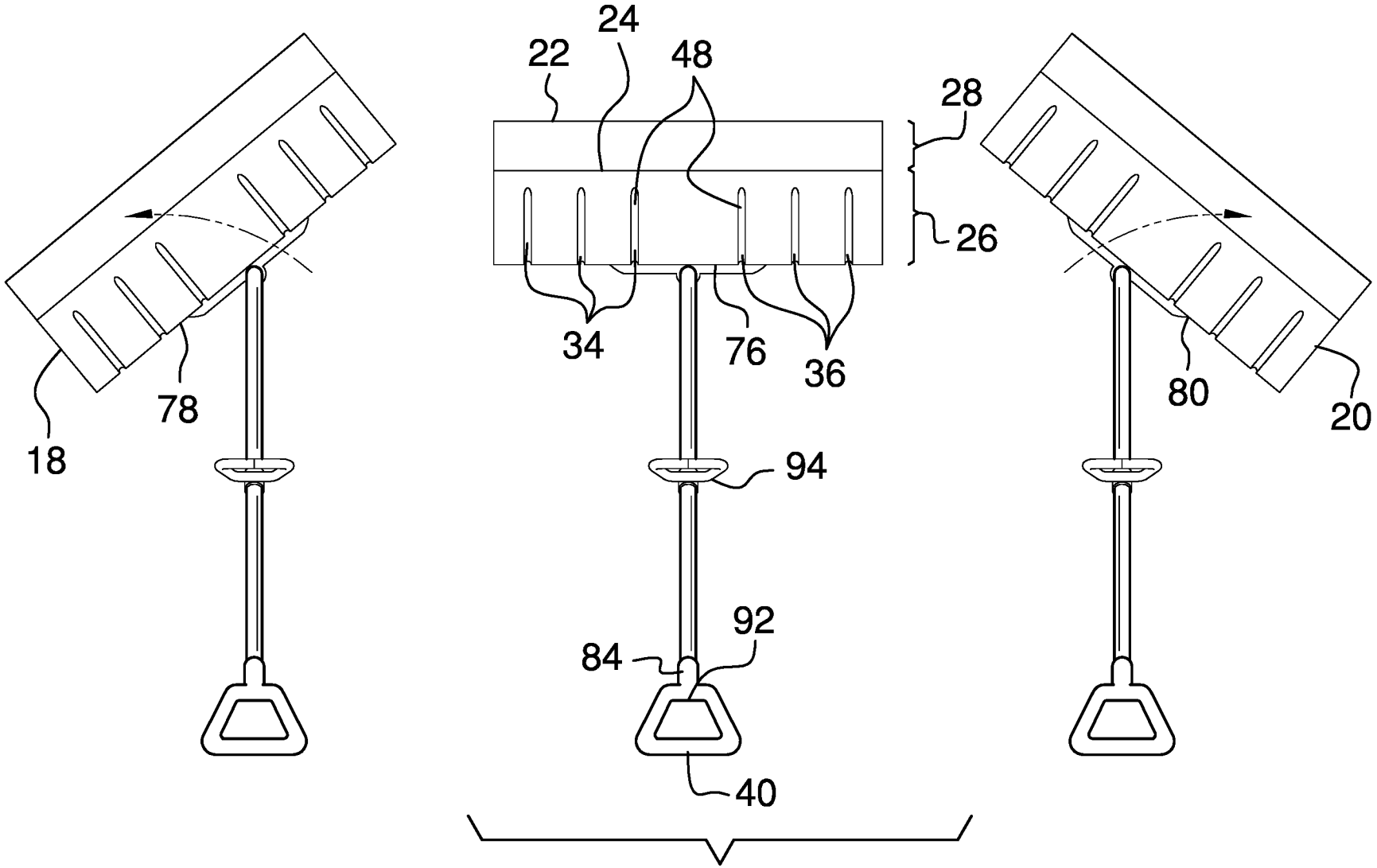
FIG. 3 is a top plan view of an embodiment of the disclosure.
Figure 4:
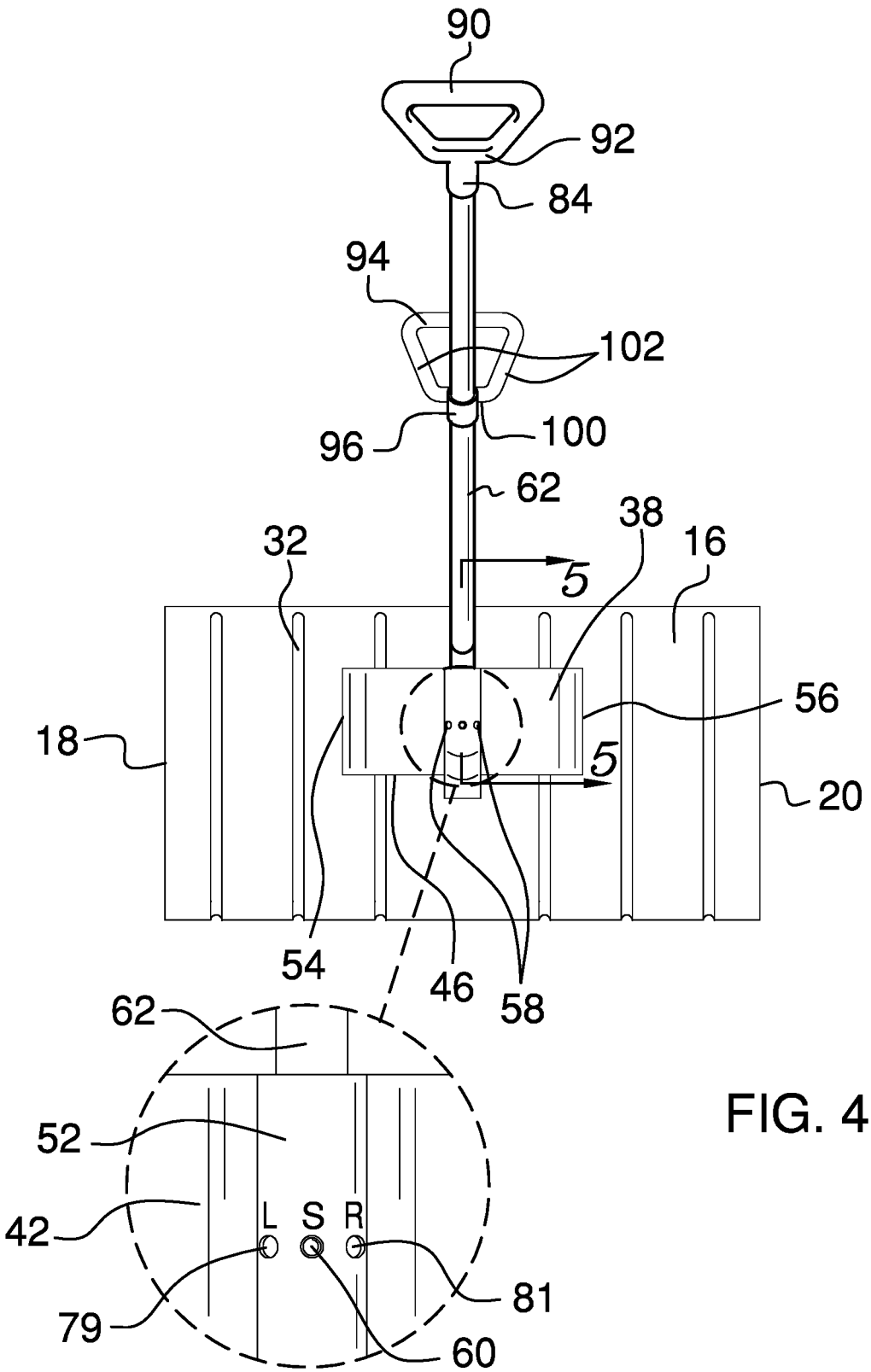
FIG. 4 is a rear elevation view of an embodiment of the disclosure.
Figure 5:
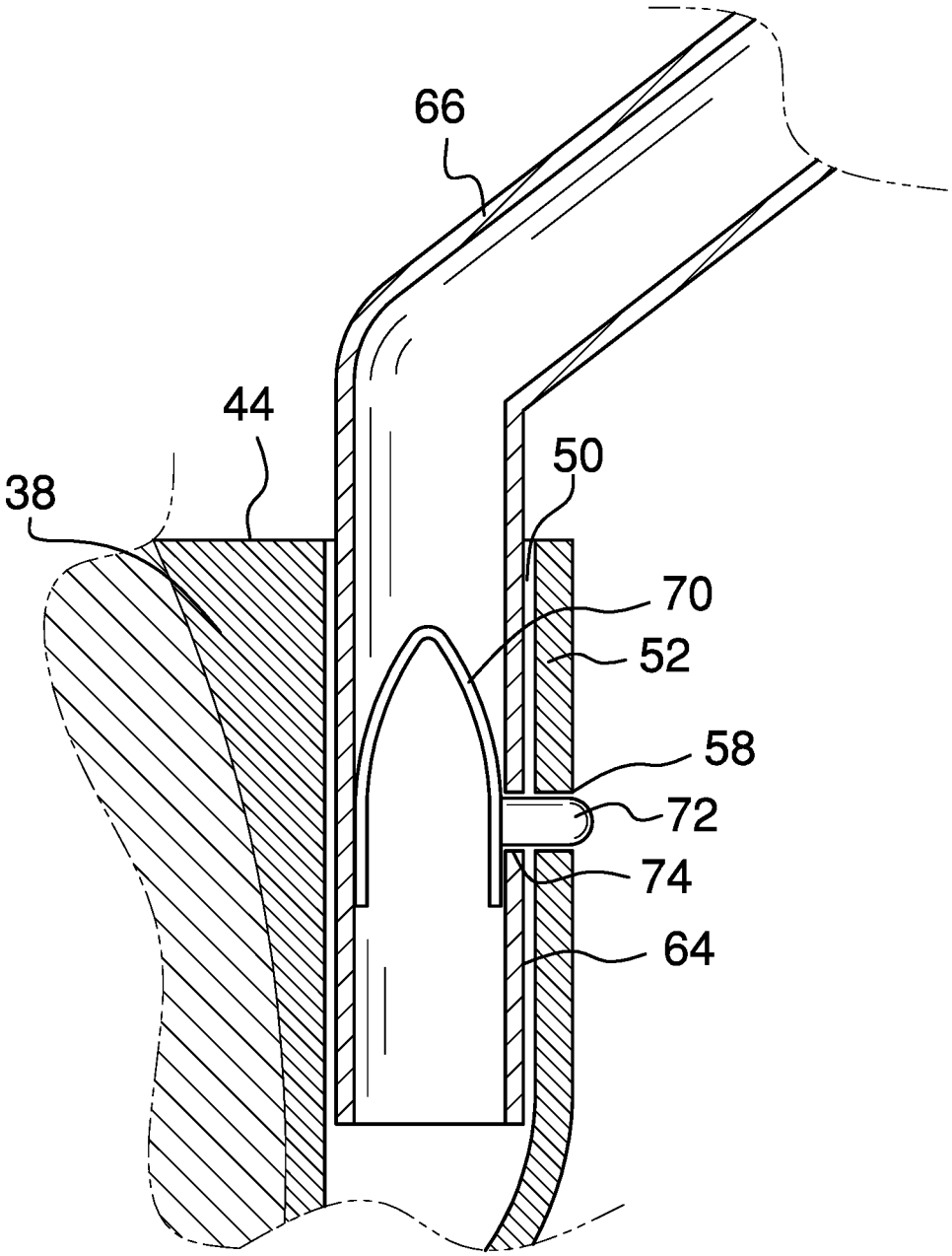
FIG. 5 is a cross-sectional view of an embodiment of the disclosure along line 5-5 of FIG. 4.

With reference now to the drawings, and in particular to FIGS. 1 through 5 thereof, a new shovel embodying the principles and concepts of an embodiment of the disclosure and generally designated by the reference numeral 10 will be described.

As best illustrated in FIGS. 1 through 5, the rotatable plow shovel apparatus 10 generally comprises a plow blade 12 having a concave front side 14, a back side 16, a left edge 18, a right edge 20, and a bottom edge 22 extending past a top edge 24. The profile of the plow blade 12 has a semi-circular portion 26 extending from the top edge 24 and a linear lip portion 28 extending from the semi-circular portion 26 to the bottom edge 22. The bottom edge 22 extends a horizontal distance past the top edge 24 equal to 25% to 50% of a horizontal depth of the semi-circular portion 26. The lip portion 28 lies in a plane forming an angle with the horizontal between 10° and 30° to force snow, sand, mud, leaves, or any other desired material up into the plow blade 12.

The plow blade 12 has a plurality of ridges 30 extending from the front side 14. Each of the plurality of ridges 30 lies in a vertical plane parallel with the profile and extends from proximal the top edge 24 to proximal the bottom edge 22. The plurality of ridges 30 is configured to aid the flow of material along the front side 14. The back side 16 may have a plurality of depressions 32 corresponding with the plurality of ridges 30 of the front side from production. The plurality of ridges 30 comprises a left grouping 34 and a right grouping 36, each comprising three evenly spaced ridges 30. The distance between the left grouping 34 and the right grouping 36 is greater than the distance between adjacent ridges 30 within each of the left grouping 34 and the right grouping 36.

A shaft housing 38 is has a curved front face 40 medially coupled to the back side 16 of the plow blade, a vertical back face 42, a top side 44, and a bottom side 46. The shaft housing 38 extends past an innermost depression 48 of each of the left grouping 34 and the right grouping 36 and the front face 40 is shaped to correspond with each of the innermost depressions 48. A shaft aperture 50 extends through the top side 44 to proximal the bottom side 46. The back face 42 has a semi-cylindrical protrusion 52 extending from the top side 44 to the bottom side 46 and medially between a left side 54 and a right side 56. The shaft aperture 50 concentrically extending through the protrusion 52. The back face 42 has a plurality of adjustment apertures 58 extending through the protrusion 52 to the shaft aperture 50 with a central adjustment aperture 60 extending through a midline of the shaft housing 38. The bottom side 46 of the protrusion 50 is rounded and the back face 42 has rounded vertical edges being the left side 54 and the right side 56.

A handle shaft 62 is coupled to the shaft housing 38. The handle shaft 62 is tubular and has a vertical engagement portion 64 rotatably engageable within the shaft aperture 50 and an angled extension portion 66 coupled to the engagement portion 64. An axis of the extension portion 66 forms an angle with the vertical axis of the engagement portion 64 between 120° and 160°. A locking pin 68 comprises a wishbone spring 70 coupled within the engagement portion 64 and a button 72 coupled to the wishbone spring 70 and extending through a button aperture 74 of the engagement portion. The wishbone spring 70 pushes the button 72 to engage with the plurality of adjustment apertures 58 when aligned. The wishbone spring 70 and the button aperture 74 allow the button 72 to be sufficiently depressed to allow the handle shaft 62 to be rotated between adjustment apertures 58. The rounded bottom side 46 of the protrusion 50 limits the depth to which the engagement portion 64 enters the shaft aperture 50 to maintain alignment between the button aperture 74 and the plurality of adjustment apertures 58.

The locking pin 68 locks the handle shaft 62 in a straight position 76, at least one alternative left tilt position 78, and at least one alternative right tilt position 80 by engaging the central adjustment aperture 60, a left adjustment aperture 79 and a right adjustment aperture 81 of the plurality of adjustment apertures 58, respectively. The handle shaft 62 in the straight position 76 lying in a plane perpendicular to a vertical tangent plane to the back side 16 of the plow blade, the handle shaft 62 in the left tilt position 78 lying in a plane forming an acute angle with the vertical tangent plane relative the left edge 18, and the handle shaft 62 in the right tilt position 80 lying in a plane forming an acute angle with the vertical tangent plane relative the right edge 20.

A first handle grip 82 has a collar 84 coupled around a proximal end 86 of the extension portion 66 of the handle shaft and a first trapezoidal handle 88 coupled to the collar 84. The first trapezoidal handle 88 has a first principal grip bar 90 wider than a first join bar 92 attached to the collar 84. A second handle grip 94 has a sleeve 96 coupled around the extension portion 66 and a second trapezoidal handle 98 coupled to the sleeve 92. The second trapezoidal handle 98 has a second principal grip bar 99 wider than a second join bar 100 coupled to the sleeve 92. A pair of angled auxiliary grip bars 102 extends between the second principal grip bar 99 and the second join bar 100. The sleeve 96 is medially coupled between the engagement portion 64 and the proximal end 86 and the second trapezoidal handle 94 lines in a plane forming an angle with the axis of the extension portion 66 between 45° and 90°.

In use, the apparatus 10 is used with the handle shaft 62 in the straight position 76 as a traditional snow shovel. The button 72 is depressed and the handle shaft 62 is rotated to either the left tilt position 78 or the right tilt position 78 and is then pushed with the bottom edge 22 along the ground, funneling snow or any other desired material along the front side 14 and out of the way to plow a path.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A rotatable plow shovel apparatus comprising:

a plow blade having a concave front side, a back side, a left edge, and a right edge;

a shaft housing coupled to the plow blade, the shaft housing having a curved front face coupled to the back side of the plow blade, a vertical back face, a top side, and a bottom side, a shaft aperture extending through the top side to proximal the bottom side, the back face having a plurality of adjustment apertures extending through to the shaft aperture, a central adjustment aperture extending through a midline of the shaft housing;

a handle shaft coupled to the shaft housing, the handle shaft having a vertical engagement portion and an angled extension portion coupled to the engagement portion, the engagement portion being rotatably engageable within the shaft aperture of the shaft housing;

a locking pin coupled to the handle shaft, the locking pin being coupled to the engagement portion and selectively engageable with each of the plurality of adjustment apertures of the shaft housing to lock the handle shaft in a straight position, at least one alternative left tilt position, and at least one alternative right tilt position, the handle shaft in the straight position lying in a plane perpendicular to a vertical tangent plane to the back side of the plow blade, the handle shaft in the left tilt position lying in a plane forming an acute angle with the vertical tangent plane relative the left edge, and the handle shaft in the right tilt position lying in a plane forming an acute angle with the vertical tangent plane relative the right edge; and a first handle grip coupled to the handle shaft, the first handle grip being coupled to a proximal end of the extension portion of the handle shaft.

2. The rotatable plow shovel apparatus of claim 1 further comprising the back face having a semi-cylindrical protrusion extending from the top side to the bottom side and medially between a left side and a right side, the shaft aperture concentrically extending through the protrusion, the plurality of adjustment apertures extending through the protrusion to the shaft aperture.

3. The rotatable plow shovel apparatus of claim 2 further comprising the bottom side of the protrusion being rounded and the back face having rounded vertical edges being the left side and the right side.

4. The rotatable plow shovel apparatus of claim 1 further comprising the handle shaft being tubular, the locking pin comprising a wishbone spring coupled within the engagement portion and a button coupled to the wishbone spring and extending through a button aperture of the engagement portion, the wishbone spring pushing the button to engage with the plurality of adjustment apertures when aligned, the wishbone spring and the button aperture allowing the button to be sufficiently depressed to allow the handle shaft to be rotated between adjustment apertures.

5. The rotatable plow shovel apparatus of claim 1 further comprising a bottom edge of the plow blade extending past a top edge.

6. The rotatable plow shovel apparatus of claim 5 further comprising the profile of the plow blade having a semi-circular portion extending from the top edge and a linear lip portion extending from the semi-circular portion to the bottom edge, the lip portion lying in a plane forming an angle with the horizontal between 10° and 30° when the engagement portion of the handle shaft is vertical.

7. The rotatable plow shovel apparatus of claim 1 further comprising the plow blade having a plurality of ridges extending from the front side, each of the plurality of ridges lying in a vertical plane parallel with the profile of the plow blade and extending from proximal a top edge to proximal a bottom edge.

8. The rotatable plow shovel apparatus of claim 7 further comprising the back side of the plow blade having a plurality of depressions corresponding with the plurality of ridges of the front side.

9. The rotatable plow shovel apparatus of claim 8 further comprising the plurality of ridges comprising a left grouping and a right grouping, each of the left grouping and the right grouping comprising three evenly spaced ridges, the distance between the left grouping and the right grouping being greater than the distance between adjacent ridges within each of the left grouping and the right grouping.

10. The rotatable plow shovel apparatus of claim 9 further comprising the shaft housing extending past an innermost depression of each of the left grouping and the right grouping, the front face being shaped to correspond with each of the innermost depressions.

11. The rotatable plow shovel apparatus of claim 1 further comprising the first handle grip having a collar coupled around the proximal end of the extension portion of the handle shaft and a first trapezoidal handle coupled to the collar.

12. The rotatable plow shovel apparatus of claim 1 further comprising a second handle grip coupled to the extension portion of the handle shaft between the engagement portion and the proximal end.

13. The rotatable plow shovel apparatus of claim 12 further comprising the second handle grip having a sleeve coupled around the extension portion and a second trapezoidal handle coupled to the sleeve, the sleeve being medially coupled between the engagement portion and the proximal end, the second trapezoidal handle lying in a plane forming an angle with the axis of the extension portion between 45° and 90°.

14. The rotatable plow shovel apparatus of claim 1 further comprising an axis of the extension portion forming an angle with the vertical axis of the engagement portion between 120° and 160°.

15. A rotatable plow shovel apparatus comprising:

a plow blade having a concave front side, a back side, a left edge, a right edge, and a bottom edge extending past a top edge, the profile of the plow blade having a semi-circular portion extending from the top edge and a linear lip portion extending from the semi-circular portion to the bottom edge, the lip portion lying in a plane forming an angle with the horizontal between 10° and 30°;

the plow blade having a plurality of ridges extending from the front side, each of the plurality of ridges lying in a vertical plane parallel with the profile and extending from proximal the top edge to proximal the bottom edge, the back side having a plurality of depressions corresponding with the plurality of ridges of the front side, the plurality of ridges comprising a left grouping and a right grouping, each of the left grouping and the right grouping comprising three evenly spaced ridges, the distance between the left grouping and the right grouping being greater than the distance between adjacent ridges within each of the left grouping and the right grouping;

a shaft housing coupled to the plow blade, the shaft housing having a curved front face medially coupled to the back side of the plow blade, a vertical back face, a top side, and a bottom side, the shaft housing extending past an innermost depression of each of the left grouping and the right grouping, the front face being shaped to correspond with each of the innermost depressions, a shaft aperture extending through the top side to proximal the bottom side, the back face having a semi-cylindrical protrusion extending from the top side to the bottom side and medially between a left side and a right side, the shaft aperture concentrically extending through the protrusion, the back face having a plurality of adjustment apertures extending through the protrusion to the shaft aperture, a central adjustment aperture extending through a midline of the shaft housing, the bottom side of the protrusion being rounded and the back face having rounded vertical edges being the left side and the right side;

a handle shaft coupled to the shaft housing, the handle shaft being tubular and having a vertical engagement portion and an angled extension portion coupled to the engagement portion, an axis of the extension portion forming an angle with the vertical axis of the engagement portion between 120° and 160°, the engagement portion being rotatably engageable within the shaft aperture of the shaft housing;

a locking pin coupled to the handle shaft, the locking pin comprising a wishbone spring coupled within the engagement portion and a button coupled to the wishbone spring and extending through a button aperture of the engagement portion, the wishbone spring pushing the button to engage with the plurality of adjustment apertures when aligned, the wishbone spring and the button aperture allowing the button to be sufficiently depressed to allow the handle shaft to be rotated between adjustment apertures;

the locking pin locking the handle shaft in a straight position, at least one alternative left tilt position, and at least one alternative right tilt position, the handle shaft in the straight position lying in a plane perpendicular to a vertical tangent plane to the back side of the plow blade, the handle shaft in the left tilt position lying in a plane forming an acute angle with the vertical tangent plane relative the left edge, and the handle shaft in the right tilt position lying in a plane forming an acute angle with the vertical tangent plane relative the right edge;

a first handle grip coupled to the handle shaft, the first handle grip having a collar coupled around the proximal end of the extension portion of the handle shaft and a first trapezoidal handle coupled to the collar; and a second handle grip coupled to the handle shaft, the second handle grip having a sleeve coupled around the extension portion and a second trapezoidal handle coupled to the sleeve, the sleeve being medially coupled between the engagement portion and the proximal end, the second trapezoidal handle lying in a plane forming an angle with the axis of the extension portion between 45° and 90°.

* * * * *